US011865413B2

(12) United States Patent
Bacon et al.

(10) Patent No.: US 11,865,413 B2
(45) Date of Patent: Jan. 9, 2024

(54) GOLF CLUB HEAD WITH HIGH DENSITY BODY AND LOW DENSITY FACE

(71) Applicant: KARSTEN MANUFACTURING CORPORATION, Phoenix, AZ (US)

(72) Inventors: Cory Bacon, Cave Creek, AZ (US); Martin Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/735,992

(22) Filed: May 3, 2022

(65) Prior Publication Data

US 2022/0266098 A1 Aug. 25, 2022

Related U.S. Application Data

(63) Continuation of application No. 16/941,358, filed on Jul. 28, 2020, now Pat. No. 11,318,357, which is a continuation of application No. 15/577,648, filed as application No. PCT/US2016/033825 on May 23, 2016, now Pat. No. 10,722,762.

(60) Provisional application No. 62/287,196, filed on Jan. 26, 2016, provisional application No. 62/165,712, filed on May 22, 2015.

(51) Int. Cl.
*A63B 53/04* (2015.01)
*A63B 53/06* (2015.01)

(52) U.S. Cl.
CPC ..... *A63B 53/04* (2013.01); *A63B 53/047* (2013.01); *A63B 53/0466* (2013.01); *A63B 53/0487* (2013.01); *A63B 53/042* (2020.08); *A63B 2209/00* (2013.01); *A63B 2209/02* (2013.01)

(58) Field of Classification Search
CPC ..... A63B 53/047; A63B 53/0475
USPC ..... 473/324–350
See application file for complete search history.

(56) References Cited

U.S. PATENT DOCUMENTS

| | | | |
|---|---|---|---|
| 4,824,110 | A | 4/1989 | Kobayashi |
| 5,062,638 | A | 11/1991 | Shira |
| 5,429,354 | A | 7/1995 | Long |
| 5,494,281 | A | 2/1996 | Chen |
| 5,518,242 | A | 5/1996 | Mahaffey |
| 5,643,103 | A | 7/1997 | Aizawa |
| 5,697,855 | A | 12/1997 | Aizawa |
| 6,099,414 | A | 8/2000 | Kusano et al. |
| 6,220,971 | B1 | 4/2001 | Takeda |

(Continued)

FOREIGN PATENT DOCUMENTS

| | | |
|---|---|---|
| JP | 05329235 | 12/1993 |
| JP | 08308965 | 11/1996 |

(Continued)

OTHER PUBLICATIONS

PCT International Search Report and Written Opinion dated Aug. 23, 2016 from corresponding PCT Application No. PCT/US2016/033825.

*Primary Examiner* — Alvin A Hunter

(57) ABSTRACT

Described herein are embodiments of a golf club head, the golf club head comprising a body and a strike face. The body comprises a first material having a first specific gravity and the strike face comprises a second material having a second specific gravity. A ratio of the first specific gravity to the second specific gravity is greater than or equal to 1.7. The body and the strike face are coupled together by welding. The body further defines a cavity.

17 Claims, 9 Drawing Sheets

(56) References Cited

U.S. PATENT DOCUMENTS

| | | | |
|---|---|---|---|
| 6,238,301 | B1 | 5/2001 | Takeda |
| 6,471,600 | B2 | 10/2002 | Tang |
| 6,478,692 | B2 | 11/2002 | Kosmatka |
| 6,723,279 | B1 | 4/2004 | Withers |
| 6,743,117 | B2 | 6/2004 | Gilbert |
| 6,769,998 | B2 | 8/2004 | Clausen et al. |
| 6,814,674 | B2 | 11/2004 | Clausen et al. |
| 6,863,625 | B2 | 3/2005 | Reyes |
| 6,949,032 | B2 | 9/2005 | Kosmatka |
| 6,981,924 | B2 | 1/2006 | Deshmukh |
| 7,022,031 | B2 | 4/2006 | Nishio |
| 7,147,576 | B2 | 12/2006 | Imamoto |
| 7,214,143 | B2 | 5/2007 | Deshmukh |
| 7,220,189 | B2 | 5/2007 | Wieland |
| 7,338,387 | B2 | 3/2008 | Nycum et al. |
| 7,393,287 | B2 | 7/2008 | Chun-Yung et al. |
| 7,621,822 | B2 | 11/2009 | Roach |
| 7,632,195 | B2 | 12/2009 | Jorgensen |
| 7,651,413 | B1 | 1/2010 | Chen |
| 7,699,719 | B2 | 4/2010 | Sugimoto |
| 8,157,668 | B2 | 4/2012 | Wahl |
| 8,342,985 | B2 | 1/2013 | Hirano |
| 8,556,745 | B2 | 10/2013 | Currie |
| 8,668,599 | B1 | 3/2014 | Cackett et al. |
| 8,840,485 | B2 | 9/2014 | Jorgensen |
| 10,722,762 | B2 | 7/2020 | Bacon et al. |
| 11,318,357 | B2 * | 5/2022 | Bacon ..... A63B 53/047 |
| 2005/0059508 | A1 | 3/2005 | Burnett |

FOREIGN PATENT DOCUMENTS

| | | |
|---|---|---|
| JP | 09154987 | 6/1997 |
| JP | 09262326 | 10/1997 |
| JP | 2001095961 | 4/2001 |
| JP | 2002186692 | 7/2002 |
| JP | 2003126314 | 5/2003 |
| JP | 2003275350 | 9/2003 |
| JP | 2007275622 | 10/2007 |
| JP | 2007117484 | 1/2011 |
| JP | 2016221180 | 12/2016 |
| WO | WO2005/082062 | 9/2005 |

* cited by examiner

GOLF CLUB HEAD WITH HIGH DENSITY BODY AND LOW DENSITY FACE

CROSS-REFERENCE TO RELATED APPLICATIONS

This is a continuation of U.S. patent application Ser. No. 16/941,358, filed on Jul. 28, 2020, now U.S. Pat. No. 11,318,357, which is a continuation of U.S. patent application Ser. No. 15/577,648, filed on Nov. 28, 2017, and issued as U.S. Pat. No. 10,722,762 on Jul. 28, 2020, which is a national stage entry of PCT Application No. PCT/US2016/33825 filed on May 23, 2016, which claims the benefit of U.S. Provisional Patent Application No. 62/165,712, filed on May 22, 2015, and U.S. Provisional Patent Application No. 62/287,196, filed on Jan. 26, 2016, the contents of which are incorporated fully herein by reference.

FIELD OF THE INVENTION

The present disclosure relates to a golf club head having a high density body and a low density face. Specifically, the present disclosure relates to wood-type golf club heads, iron-type golf club heads, wedge-type golf club heads, and putter-type golf club heads.

BACKGROUND OF THE INVENTION

Golf club heads may include wood-type club heads (e.g., drivers and fairway woods), iron-type club heads (e.g., irons and wedges), and putter-type club heads. Golf club head designs vary and generally aim to optimize head center of gravity position and increase club head moment of inertia. The head center of gravity position affects performance characteristics of the golf club including direction, trajectory, distance, and spin of the golf ball. Increased club head moment of inertia increases the consistency of ball trajectory and direction for off-center hits. Many golf club heads are designed to optimize head center of gravity position and increase club head moment of inertia by using weighting ports or inserts. These designs may require complicated manufacturing and assembly processes. In addition, use of weight ports can affect the overall aerodynamics of the club head. Therefore, there is a need in the art for the ability to distribute weight of golf club heads more uniformly to optimize center of gravity positions and increase club head moment of inertia.

Figure 1:
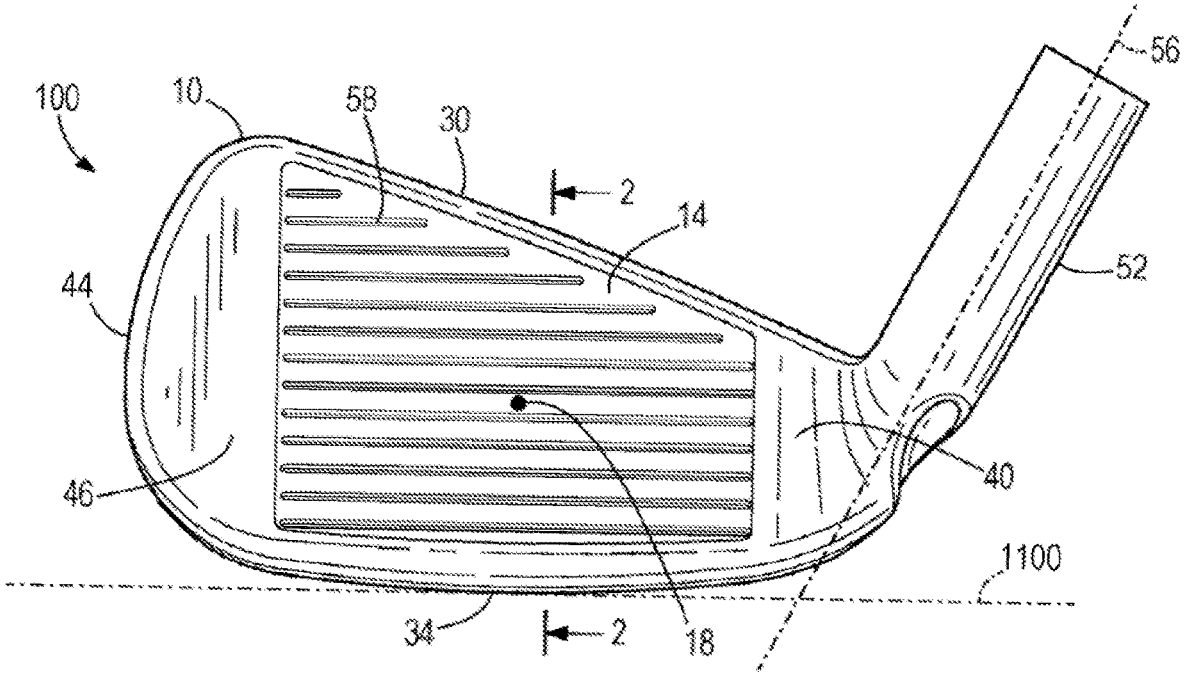
FIG. 1 illustrates a front perspective view of an embodiment of a golf club head.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

In the embodiments described below, a golf club head includes a body made of a high density material and a face made of a lower density material. The ratio of specific gravity of the material of the body to the specific gravity of the material of the face may be greater than or equal to approximately 1.7. The club head having the body with a substantially greater density than the face increases the moment of inertia of the club head and positions the head center of gravity closer to the bottom of the club head than a club head without the high density body and lower density face. Positioning of the center of gravity toward the bottom of the club head reduces spin on the ball in wood-type club heads and increases the launch angle of the ball in iron-type club heads. Using a high density material for the body and a lower density material for the face maximizes the distribution of weight to the outmost perimeter of the club head away from the center of gravity, thereby maximizing the moment of inertia of the club head. Further, using a high density material for the body to increase moment of inertia of the club head provides a simpler means of manufacturing a club head with a high moment of inertia compared to the use of weight ports and weight inserts. The ability to increase club head moment of inertia and optimize the head center of gravity position using a high density body and a low density face may aid in achieving desired performance characteristics of the club head.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

FIGS. 1-5 illustrate an embodiment of a golf club head 100 having a body 10, a strike face 14, and a head center of gravity 18. The strike face 14 includes a geometric center 18, a front side 22 and a back side 26. The body 10 includes a top 30, a bottom 34 opposite the top 30, a heel 40, a toe 44 opposite the heel 40, a front end 46, a back end 48 opposite the front end 46, and a hosel 52 defining a hosel axis 56. In some embodiments, the hosel 52 may include a notch or recess (not shown).

In the illustrated embodiment of FIGS. 1-5, the strike face 14 defines a portion of the front end 46 of the club head 100 and is trapezoidal in shape. Further, the front side 22 of the strike face 14 includes a plurality of grooves 58.

Figure 2:
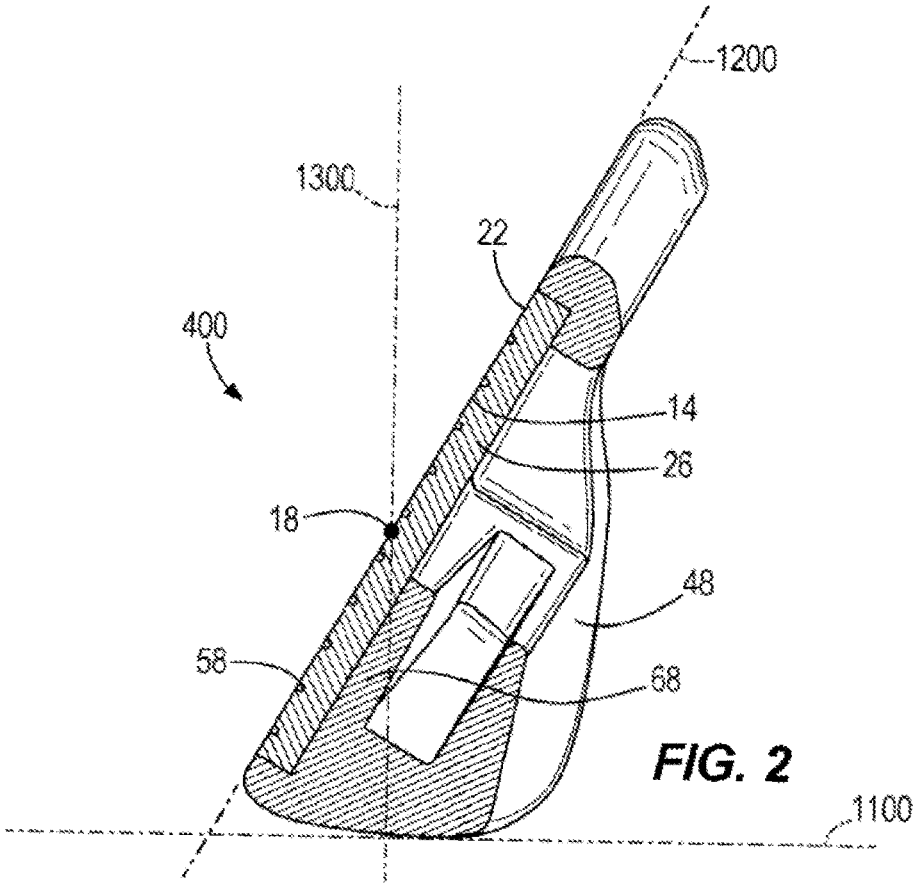
FIG. 2 illustrates a side, cross sectional view of the golf club head of FIG. 1.

FIGS. 1-2 illustrate the club head 100 at an address position relative to a ground plane 1100. FIG. 1 illustrates that the hosel axis 56 is positioned at an angle with the ground plane 1100 with respect to a front view of the club head 100. Further, the hosel axis 56 is orthogonal to the ground plane 1100 with respect to a side view of the club head 100. The strike face 14 of the club head 100 defines a loft plane 1200 tangent to the geometric center 18 of the strike face 14 and a front plane 1300 extending through the geometric center 18 of the strike face 14. The front plane 1300 is orthogonal to the ground plane 1100 when the club head 100 is at the address position.

Figure 3:
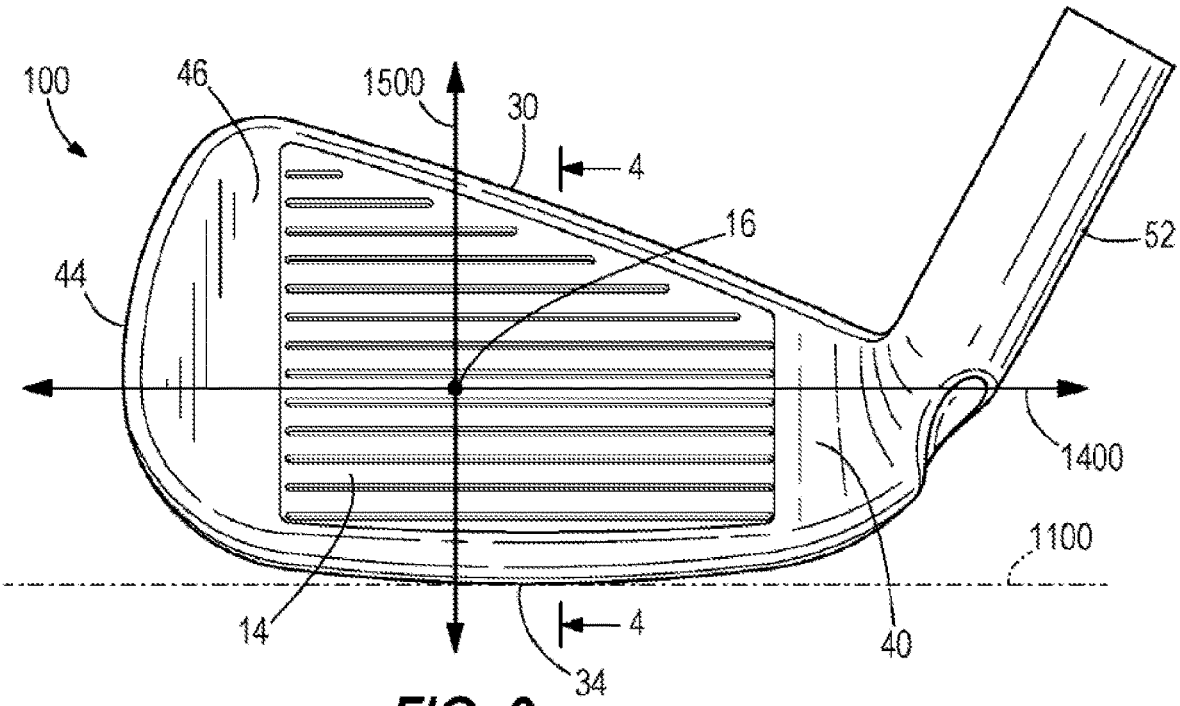
FIG. 3 illustrates another front perspective view of the golf club head of FIG. 1.
Figure 4:
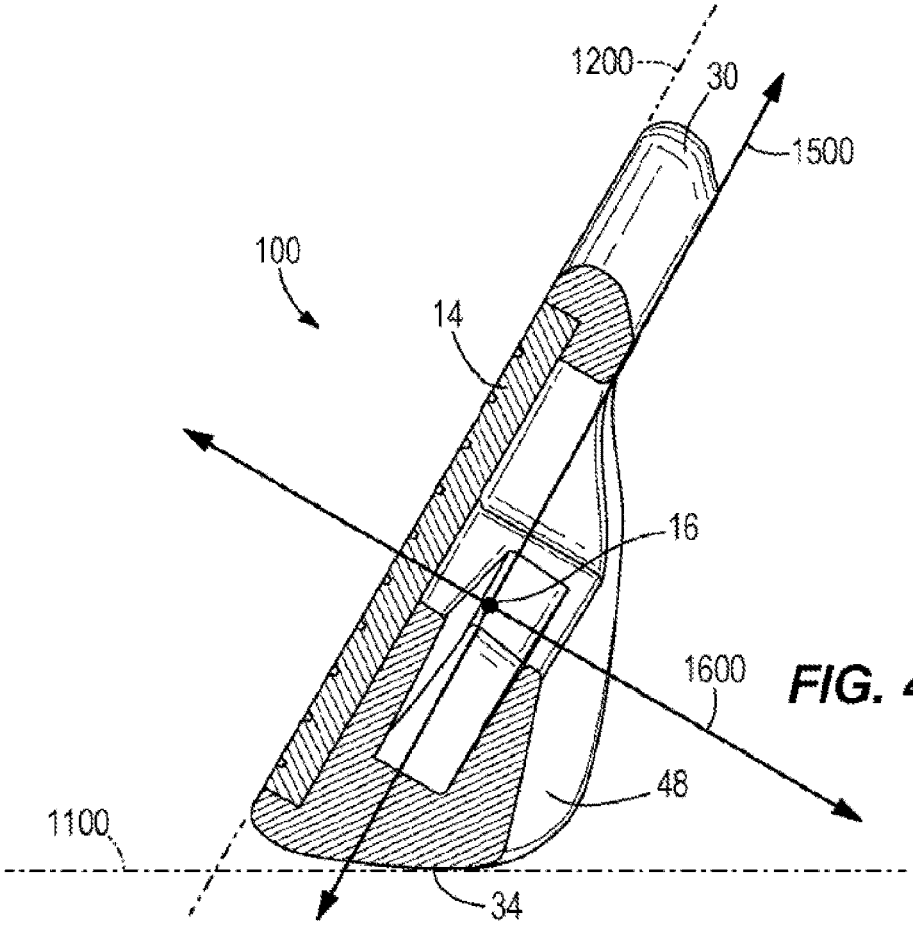
FIG. 4 illustrates another side, cross sectional view of the golf club head of FIG. 1.

Referring to FIGS. 3-4, the head center of gravity 16 defines an origin of a coordinate system including an x-axis 1400, a y-axis 1500, and a z-axis 1600, where the x-axis 1400, the y-axis 1500, and the z-axis 1600 are perpendicular to each other. The x-axis 1400 extends through the head center of gravity 16 from the heel 40 to the toe 44 of the club head 100, parallel to the loft plane 1200. The y-axis 1500 extends through the head center of gravity 16 from the top 30 to the bottom 34 of the club head 100, parallel to the loft plane 1200. The z-axis 1600 extends through the head center of gravity 16 from the strike face 14 to the back end 48 of the club head 100, orthogonal to the loft plane 1200.

Figure 5:
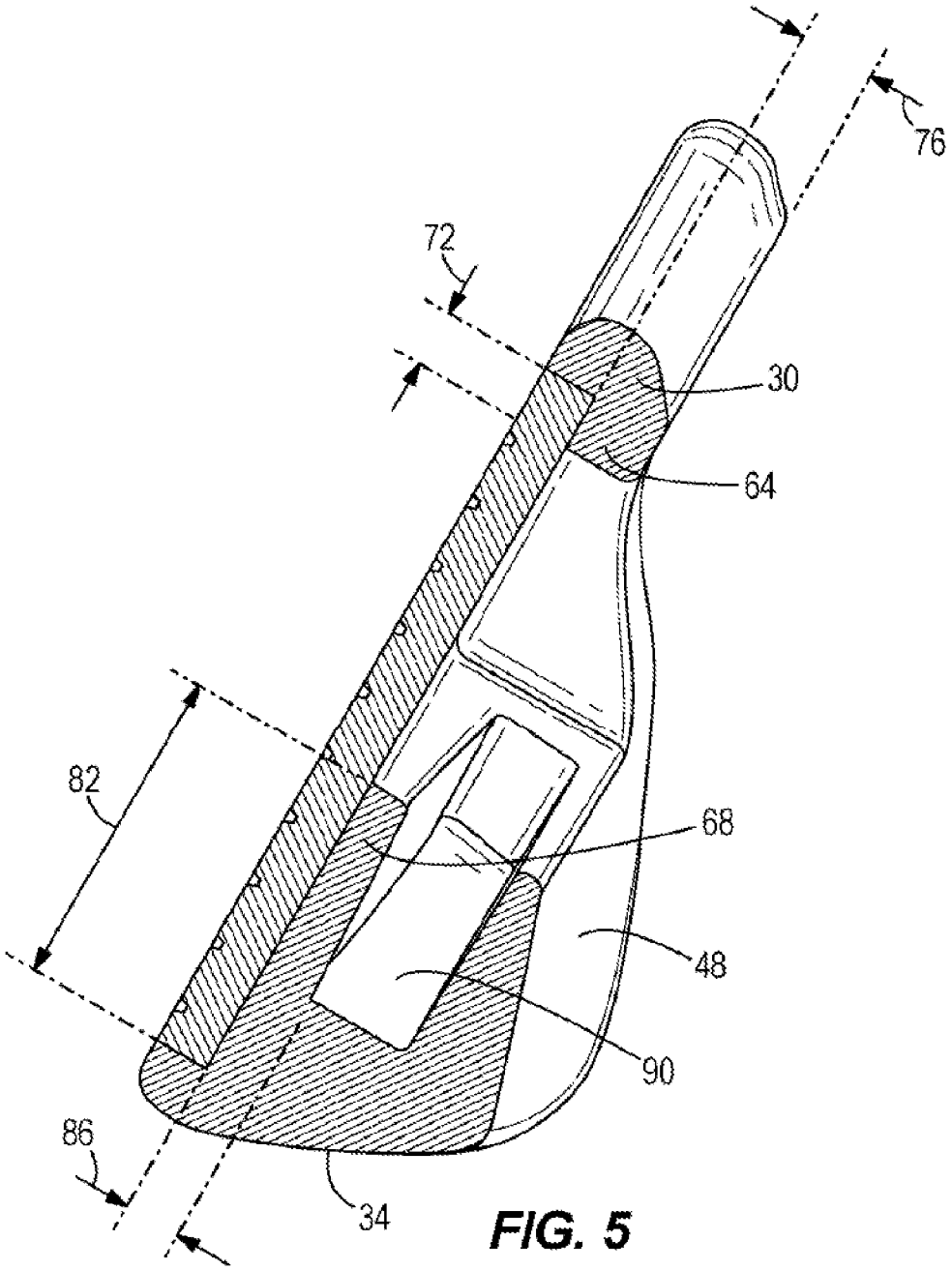
FIG. 5 illustrates another side, cross sectional view of the golf club head of FIG. 1.

In the illustrated embodiment, referring to FIG. 5, the body 10 includes a first support member 64 and a second support member 68. The first support member 64 is positioned adjacent to the top 30 of the body 10 and the back side 48 of the strike face 14. The second support member 68 is positioned adjacent to the bottom 34 of the body 10 and the back side 48 of the strike face 14. The first support member 64 has a first length 72 and a first width 76, and the second support member 68 has a second length 82 and a second width 86. The first length 72 of the first support member 64 defines a length 72 of the top of the strike face 14 (i.e. a portion of the strike face 14 near the top 30) that is supported by the body 10 relative to the face height. Further, the second length 82 of the second support member 68 defines a length 82 of the bottom of the strike face 14 (i.e. a portion of the strike face 14 near the bottom 24) that is supported by the body 10 relative to the face height.

With continued reference to FIG. 5, the body 10 further includes a cavity 90. The cavity 90 is positioned near the back end 48 of the body 10, offset from the back side 26 of the strike face 14. In the illustrated embodiment, the cavity 90 is open and is configured to receive a weight (not shown). Further, in the illustrated embodiment, the cavity 90 is rectangular in shape and has a constant shape and cross-sectional area at various positions relative to the heel 40 and/or the toe 44.

Figure 6:
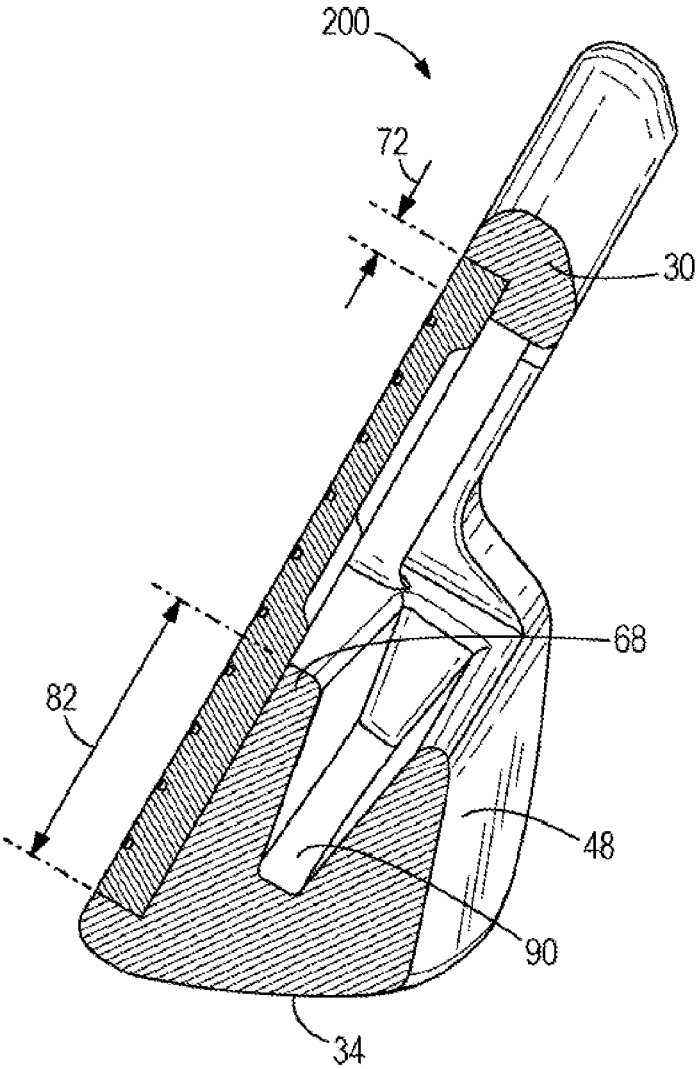
FIG. 6 illustrates a side, cross sectional view of another embodiment of a golf club head.

FIG. 6 illustrates another embodiment of the golf club head 200 having a body 10, a strike face 14, and a head center of gravity. The strike face 14 includes a geometric center, a front side 22 and a back side 26. The body 10 includes a top 30, a bottom 34 opposite the top 30, a heel, a toe opposite the heel, a front end 46, a back end 48 opposite the front end 46, and a hosel defining a hosel axis. In some embodiments, the hosel may include a notch or recess (not shown).

In the illustrated embodiment, referring to FIG. 6, the top and the bottom of the strike face 14 are supported by the body 10 of the club head 200. The top of the strike face 14 is supported by the body 10 along a first length 72, and the bottom of the strike face 14 is supported by the body 10 along a second length 82.

With continued reference to FIG. 6, the body 10 further includes a cavity 90. The cavity 90 is positioned near the back end 48 of the body 10, offset from the back side 26 of the strike face 14. In the illustrated embodiment, the cavity 90 is open and is configured to receive a weight (not shown). Further, in the illustrated embodiment, the cavity 90 is triangular in shape and has a constant shape at various positions relative to the heel and/or the toe. The cross-sectional area of the cavity 90 varies with position from the heel and/or the toe of the club head 200. For example, the distance of offset of the cavity 90 from the back side 26 of the strike face 14 is greater near the heel and the toe than near the center of the cavity 90. Accordingly, the cross-sectional area of the cavity 90 decreases near the heel and the toe compared to the center of the cavity 90.

Figure 7:
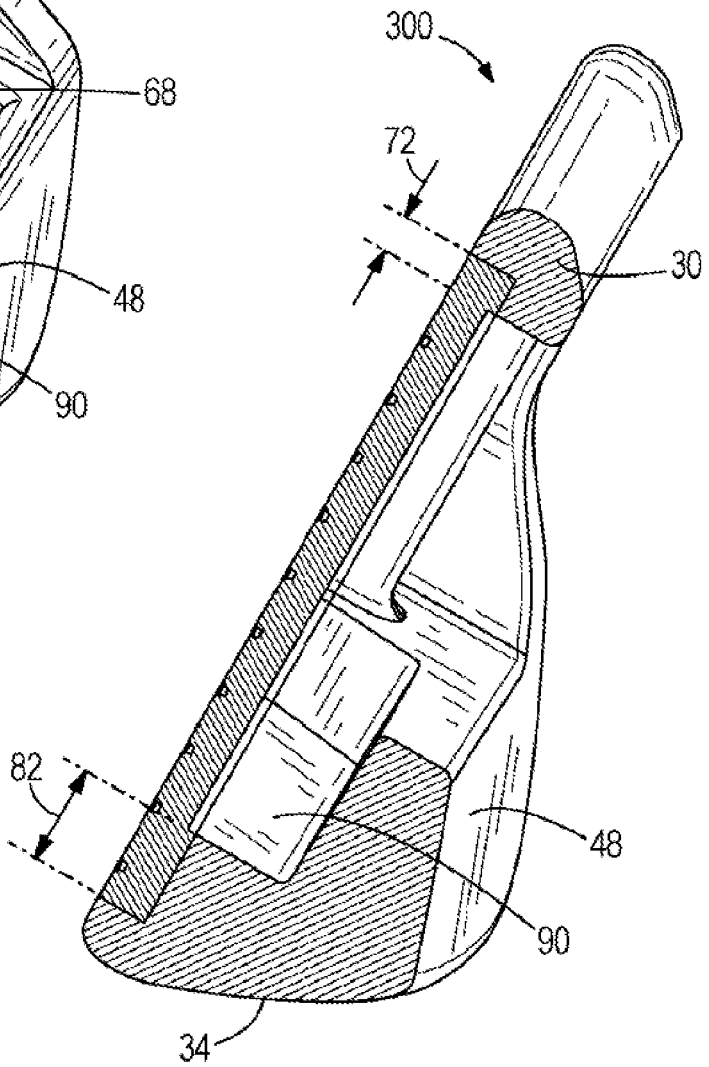
FIG. 7 illustrates a side, cross sectional view of another embodiment of a golf club head.

FIG. 7 illustrates another embodiment of the golf club head 300 having a body 10, a strike face 14, and a head center of gravity 16. The strike face 14 includes a geometric center, a front side 22 and a back side 26. The body 10 includes a top 30, a bottom 34 opposite the top 30, a heel, a toe opposite the heel, a front end 46, a back end 48 opposite the front end 46, and a hosel defining a hosel axis. In some embodiments, the hosel may include a notch or recess (not shown).

In the illustrated embodiment, referring to FIG. 7, the top and the bottom of the strike face 14 are supported by the body 10 of the club head 300. The top of the strike face 14 is supported by the body 10 along a first length 72, and the bottom of the strike face 14 is supported by the body 10 along a second length 82.

With continued reference to FIG. 7, the body 10 further includes a cavity 90. The cavity 90 is positioned near the back end 48 of the body 10, directly adjacent to the back side 26 of the strike face 14. In the illustrated embodiment, the cavity 90 is open and is configured to receive a weight (not shown). Further, in the illustrated embodiment, the cavity 90 is rectangular in shape and has a constant shape and cross-sectional area at various positions relative to the heel and/or the toe.

FIGS. 8-12 illustrate another embodiment of the golf club head 400 having a body 10, a strike face 14, and a head center of gravity 16. The strike face 14 includes a geometric center 18, a front side 22 and a back side 26. The body 10 includes a top 30, a bottom 34 opposite the top 30, a heel 40, a toe 44 opposite the heel 40, a front end 46, a back end 48 opposite the front end 46, and a hosel 52 defining a hosel axis 56. In some embodiments, the hosel 52 may include a notch or recess (not shown).

In the illustrated embodiment of FIGS. 8-12, the strike face 14 defines a portion of the front end 46 of the club head 400 and is trapezoidal in shape. The strike face 14 includes a protruding back side 26. Further, the front side 22 of the strike face 14 includes a plurality of grooves 58.

Figure 12:
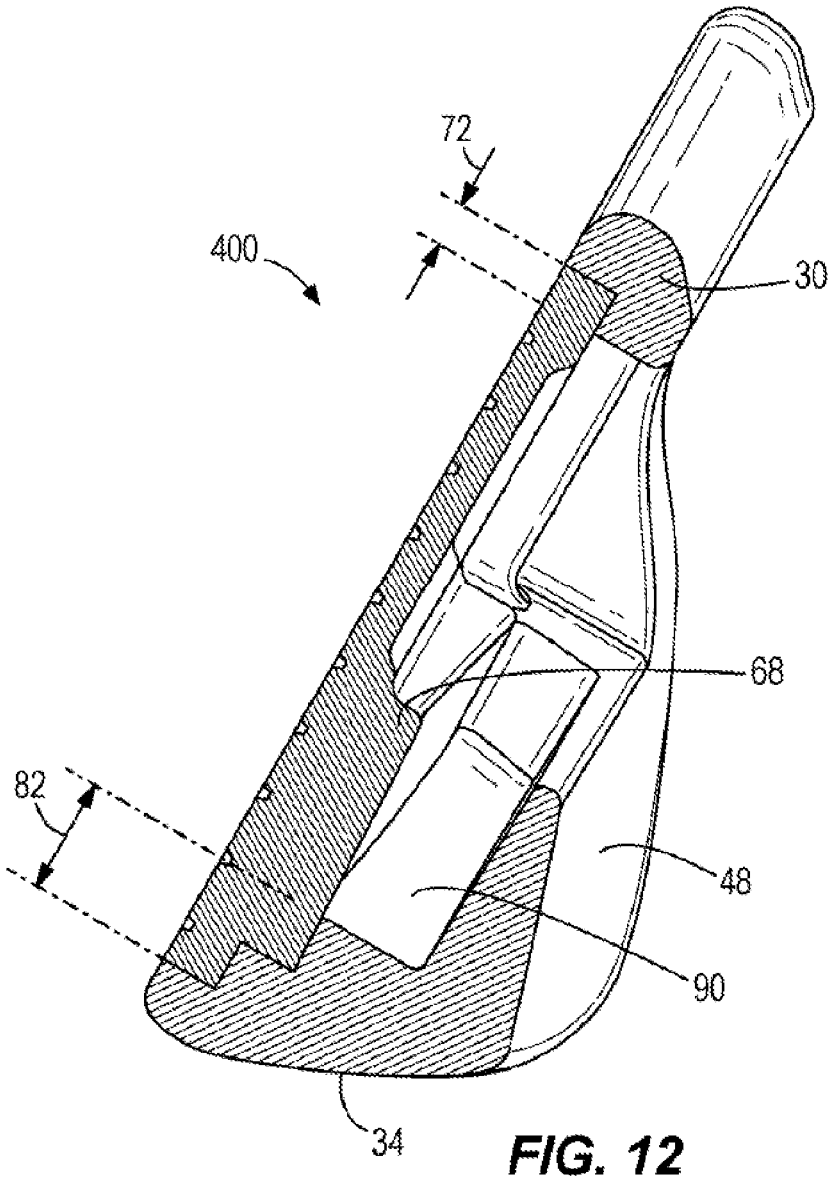
FIG. 12 illustrates another perspective, cross sectional view of the golf club head in FIG. 8, taken along line 4-4.

In the illustrated embodiment, referring to FIG. 12, the top and the bottom of the strike face 14 are supported by the body 10 of the club head 400. The top of the strike face 14 is supported by the body 10 along a first length 72, and the bottom of the strike face 14 is supported by the body 10 along a second length 82.

With continued reference to FIG. 12, the body 10 further includes a cavity 90. The cavity 90 is positioned near the back end 48 of the body 10, directly adjacent to the protruding back side 26 of the strike face 14. In the illustrated embodiment, the cavity 90 is open and is configured to receive a weight (not shown). Further, in the illustrated embodiment, the cavity 90 is rectangular in shape and has a constant shape at various positions relative to the heel 40 and/or the toe 44.

Figure 13:
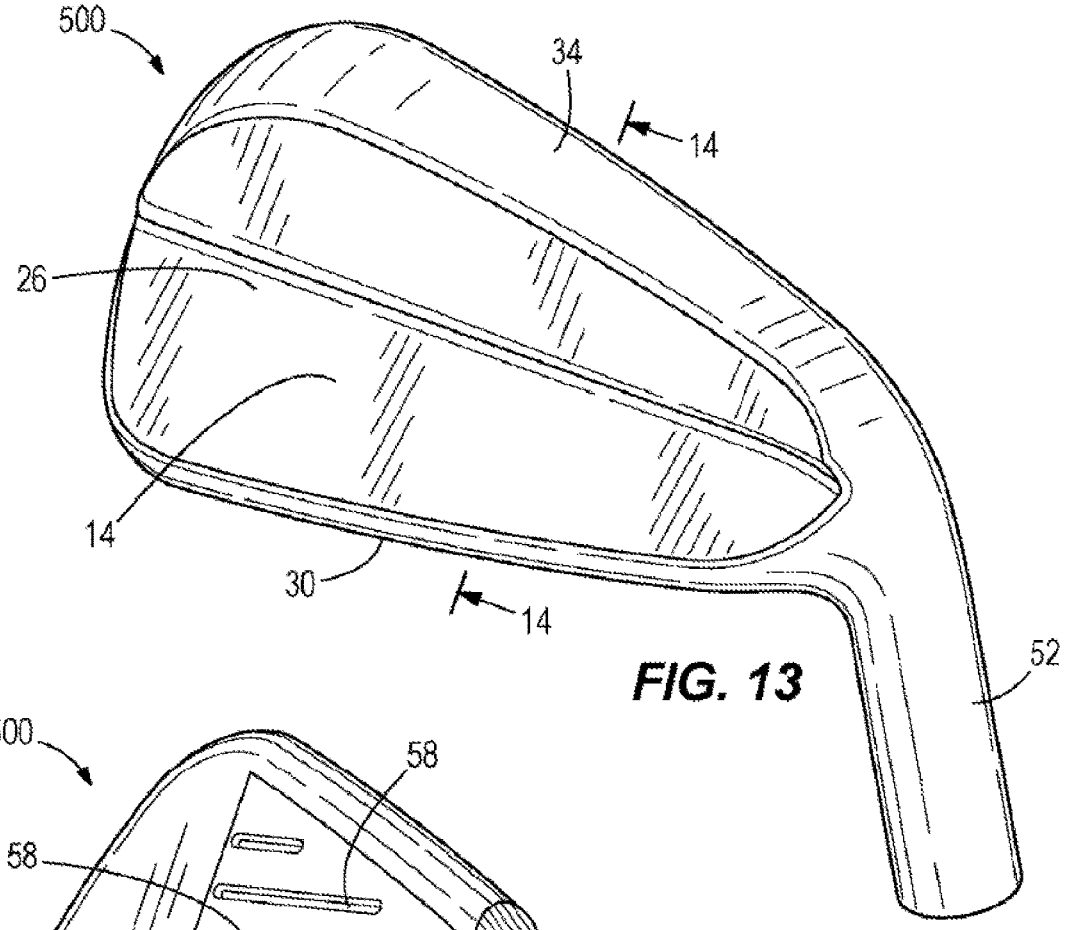
FIG. 13 illustrates a rear perspective view of another embodiment of a golf club head.
Figure 14:
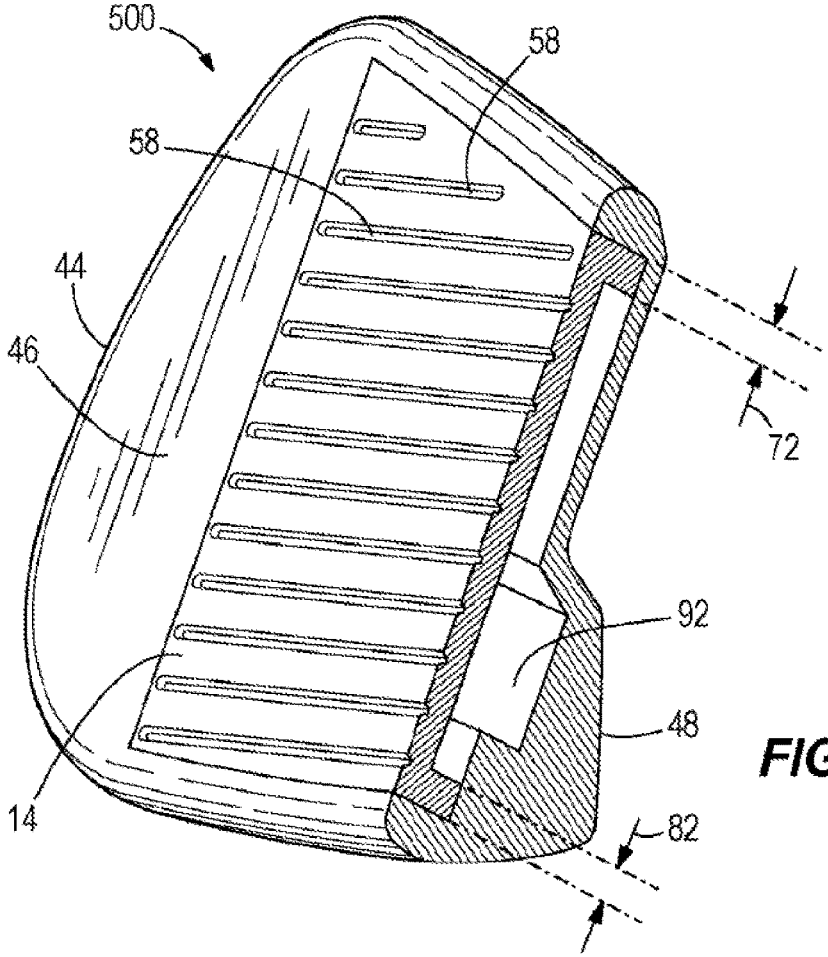
FIG. 14 illustrates a perspective, cross sectional view of the golf club head in FIG. 13, taken along line 7-7.
Figure 15:
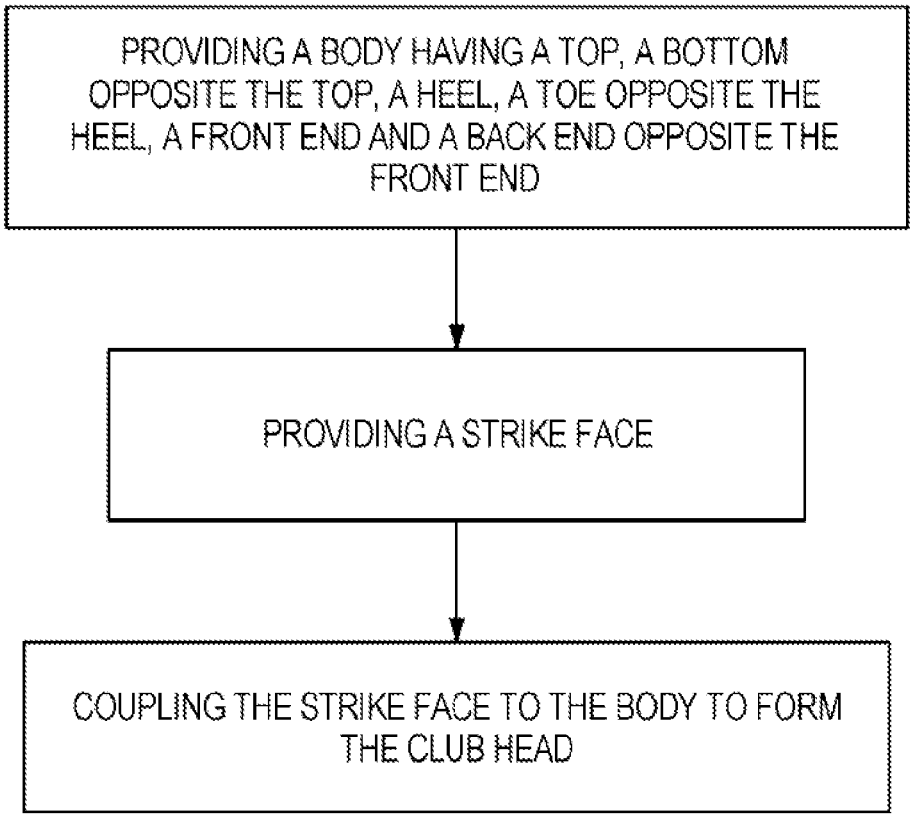
FIG. 15 illustrates a flow chart showing an exemplary method of manufacturing golf club heads according to an embodiment of the invention.

FIGS. 13-14 illustrate another embodiment of the golf club head 500 having a body 10, a strike face 14, and a head center of gravity. The strike face 14 includes a geometric center, a front side 22 and a back side 26. The body 10 includes a top 30, a bottom 34 opposite the top 30, a heel 40, a toe 44 opposite the heel 40, a front end 46, a back end 48 opposite the front end 46, and a hosel defining a hosel axis. In some embodiments, the hosel may include a notch or recess (not shown).

In the illustrated embodiment of FIGS. 13-14, the strike face 14 defines a portion of the front end 46 of the club head and is trapezoidal in shape. The strike face 14 includes a recessed back side 26 and a plurality of grooves 58 on the front side 22.

In the illustrated embodiment, referring to FIG. 14, the top and the bottom of the strike face 14 are supported by the body 10 of the club head 400. The top of the strike face 14 is supported by the body 10 along a first length 72, and the bottom of the strike face 14 is supported by the body 10 along a second length 82. Further, in the illustrated embodiment, the body 10 further includes a cavity 90. The cavity 90 is enclosed defining a hollow interior 92 of the club head 500.

Figure 10:
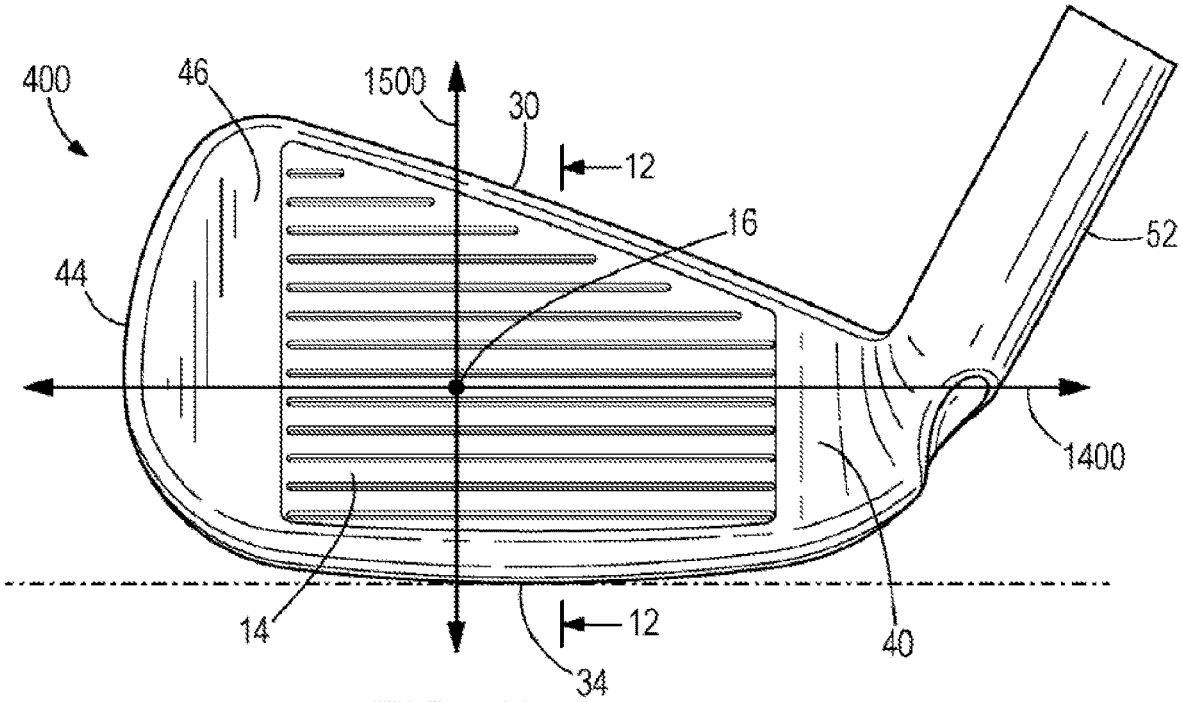
FIG. 10 illustrates another front perspective view of the golf club head in FIG. 8.
Figure 11:
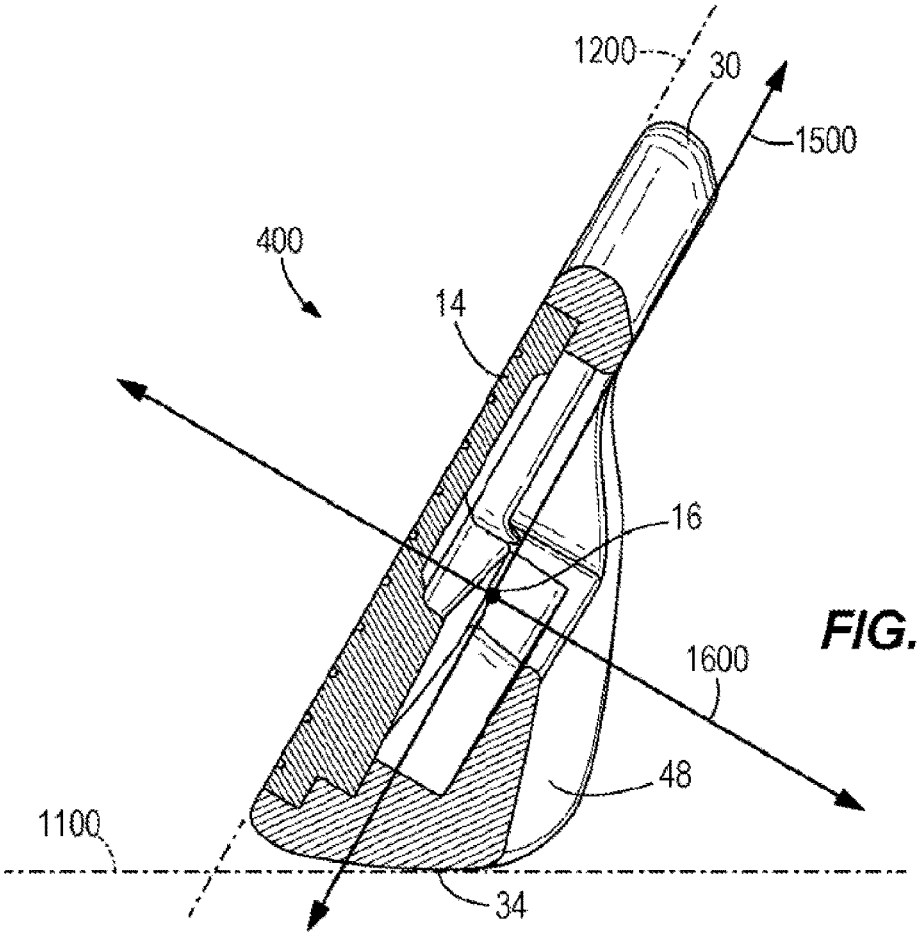
FIG. 11 illustrates another perspective, cross sectional view of the golf club head in FIG. 8, taken along line 4-4.

Referring to FIGS. 1, 3, and 10, in many embodiments, the strike face 14 of the club head described herein (e.g. club head 100, 400, 500) defines a portion of the front end 46 of club head and is trapezoidal in shape. In other embodiments, the strike face 14 may define the entire front end 46 of the club head. Further, in other embodiments, the strike face may have any shape including a polygon or a shape with at least one curved surface, such as, for example, circular, elliptical, square, rectangular, triangular, or any other shape capable of being positioned on the front end 46 of the body 10.

Referring to FIGS. 1, 3, and 10, in many embodiments, the strike face 14 of the club head described herein (e.g. club head 100, 400, 500) includes a plurality of grooves 58. In other embodiments, the front side 22 of the strike face 14 may be devoid of grooves 58, or a portion of the front side 22 of the strike face 14 may include grooves 58. For example, grooves may cover any percentage of the front side 22 of the strike face 14 greater than 0 and less than 100%. For example, grooves 58 may cover approximately 10%, 20%, 30%, 40%, 50%, 60%, 70%, 80%, 90%, or any other percent of the front side 22 of the strike face 14 greater than 0 and less than 100%.

Referring to FIGS. 1-14, in many embodiments, the club head described herein (e.g. club head 100, 200, 300, 400, 500) includes a cavity 90. In other embodiments, the club head can be devoid of a cavity. Further, in other embodiments, the club head can include an open or enclosed cavity. Further still, the club head can include a cavity having any cross-sectional shape, such as a rectangle, square, circle, ellipse, trapezoid, or any other polygon or shape with at least one curved surface. In other embodiments, the club head can have a cavity with a constant cross-sectional shape from the heel 40 to the toe 44, or the club head can have a cavity with a varying cross-sectional shape from heel 40 to toe 44.

Referring to FIGS. 1-14, the body 10 of the club head (e.g. club head 100, 200, 300, 400, 500), 200, 300, 400, 500 comprises a first material having a first density and a first volume. The first density of the body 10 corresponds to a first specific gravity, wherein the first specific gravity is the ratio of the first density to the density of water at 4 degrees Celsius (4° C.).

The body 10 of the club head (e.g. club head 100, 200, 300, 400, 500) comprises the first material. In some embodiments, the first material may comprise a single material. In some embodiment, the first material may comprise a combination or plurality of materials, each of the plurality of materials having a different density and a different specific gravity. In these embodiments, the densities of each of the plurality of materials of the body 10 may be averaged to represent the first density of the body 10 of the club head. Similarly, the specific gravities of each of the plurality of materials of the body 10 may be averaged to represent the first specific gravity of the body 10.

The first material may be any suitable material having a first specific gravity greater than 7.8. For example, the first material may have a first specific gravity ranging from approximately 7.8 to 14. Specifically, the first material may have a first specific gravity greater than or equal to approximately 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10, 10.1, 10.2, 10.3, 10.4, 10.5, 10.6, 10.7, 10.8, 10.9, 11.0, 11.5, 12.0, 12.5, 13.0, 13.5, 14.0, or any other value greater than 7.8.

The first material may be any suitable material including bismuth, brass, cadmium, cobalt, erbium, hafnium, holmium, lead, lead ore, lead oxide, lutetium, molybdenum, nickel, osmium, palladium, rhenium, rhodium, ruthenium, silver, tantalium, thallium, thorium, thulium, tungsten, tungsten carbide, uranium, other metals, composites, metal alloys, or any other homogeneous or heterogeneous material, wherein the first specific gravity of the first material is greater than approximately 7.8. The first material may have a specific gravity greater than 7.8, but may have a portion of the first material (e.g., a metal alloy) comprising a material having a specific gravity less than 7.8 such as aluminum, ferrosilicon, graphite, indium, iron, cast iron, wrought iron, galena, manganese, nickel, polycarbonate, polyethylene, polyethermide, polyphenylene sulfide, polymethylpentene, selenium, steel (all types), tin, titanium, vanadium, zinc, or other alloys thereof.

For example, the first material can be a steel alloy having approximately 18-19.5% by weight chromium, approximately 8.0-9.5% by weight nickel, approximately 8.0-10.0% by weight tungsten, with the remaining alloy composition comprising iron and other trace elements (e.g. carbon, silicon, manganese, copper, molybdenum). In this example, the first material has a specific gravity of approximately 8.25.

For further example, the first material can be a steel alloy having approximately 6.0-7.0% by weight chromium, approximately 19-20% by weight nickel, approximately 15.5-16.5% by weight tungsten, with the remaining alloy composition comprising iron and other trace elements (e.g. carbon, silicon, manganese, copper, molybdenum). In this example, the first material has a specific gravity of approximately 8.80.

For further example, the first material can be a steel alloy having approximately 12-13.5% by weight chromium, approximately 48-50% by weight nickel, approximately 18.0-21.5% by weight tungsten, approximately 1.5-2.0% by weight molybdenum, with the remaining alloy composition comprising iron and other trace elements (e.g. carbon, silicon, manganese, and copper). In this example, the first material has a specific gravity of approximately 9.30.

In examples where the first material comprises a steel alloy, increasing the tungsten composition can increase the specific gravity of the first material In some examples, the first material comprising a steel alloy can include greater than or equal to 7.5% by weight tungsten, greater than or equal to 8.0% by weight tungsten, greater than or equal to 9.0% by weight tungsten, greater than or equal to 10% by weight tungsten, greater than or equal to 15% by weight tungsten, or greater than or equal to 20% by weight tungsten. Further, in examples where the first material comprises a steel alloy, increasing the nickel composition can increase the specific gravity of the first material. In some examples, the first material comprising a steel alloy can include greater than or equal to 7.5% by weight nickel, greater than or equal to 10% by weight nickel, greater than or equal to 15% by weight nickel, greater than or equal to 25% by weight nickel, greater than or equal to 30% by weight nickel, or greater than or equal to 45% by weight nickel.

In the illustrated embodiments, the strike face 14 of the club head (e.g. club head 100, 200, 300, 400, 500) is made of a second material having a second density and a second volume. The second density of the strike face 14 corresponds to a second specific gravity, wherein the second specific gravity is the ratio of the second density to the density of water at 4 degrees Celsius (4° C.).

The strike face 14 of the club head (e.g. club head 100, 200, 300, 400, 500) comprises the second material. In some embodiments, the second material may comprise a single material. In other embodiments, the second material may comprise a plurality of materials, each of the plurality of materials having a different density and a different specific gravity. In these embodiments, the densities of each of the plurality of materials of the strike face 14 may average to be the second density of the strike face 14 of the club head (e.g. club head 100, 200, 300, 400, 500). Similarly, the specific gravities of each of the plurality of materials of the strike face 14 may average to be the second specific gravity of the strike face 14. Further, in other embodiments, the second material of the strike face 14 may have a variable density and a variable specific gravity, wherein the average density of the second material is the second density, and the average specific gravity of the second material is the second specific gravity.

The second material may be any suitable material having a second specific gravity less than or equal to approximately 4.6. For example, the second material may have a second specific gravity ranging from approximately 2.0 to approximately 4.5. Specifically, the second material may have a second specific gravity of approximately 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, or any other value less than or equal to approximately 4.6. In some embodiments, the second material may have a second specific gravity less than or equal to approximately 4.6, 4.5, 4.4, 4.3, 4.2, 4.1, 4.0, 3.9, 3.8, 3.7, 3.6, 3.5, 3.3, 3.3, 3.2, 3.1, or 3.0.

The second material may be any suitable material including barium, beryllium, epoxy, glass, graphite, gypsum, iron carbide, iron slag, manganese, magnetite, plastics, polycarbonate, polyethylene, polyethermide, polyphenylene sulfide, polymethylpentene, polymid, polypropylene, polysulfone, polyurethane, rubidium, selenium, scandium, titanium, titanium alloys (e.g. Ti-6-4), other metals, composites, metal alloys, or any other homogeneous or heterogeneous material, wherein the second specific gravity of the second material is less than or equal to approximately 4.6. The second material may have a specific gravity less than 4.6, but may have a certain portion of the second material (e.g., a metal alloy) comprising a material having a specific gravity greater than 4.6 such as aluminum bronze alloy, bismuth, brass, cadmium, cobalt, erbium, ferrosilicon, galena, graphite, hafnium, holmium, indium, iron, cast iron, wrought iron, lead, lead ore, lead oxide, lutetium, molybdenum, nickel, osmium, rhodium, ruthenium, steel (all types), tantalium, thallium, thorium, thulium, tin, tungsten, vanadium, zinc, or other alloys thereof.

In the illustrated embodiments, the first specific gravity is substantially greater than the second specific gravity. Specifically, the ratio of the first specific gravity to the second specific gravity is greater than or equal to approximately 1.7. For example, the ratio of the first specific gravity to the second specific gravity may range from approximately 1.7 to 3.5, from approximately 1.8 to 3.5, from approximately 1.9 to 3.5, from approximately 1.8 to 3.0, or from approximately 1.9 to 3.0. Specifically, the ratio of the first specific gravity to the second specific gravity may be approximately 1.7, 1.72, 1.74, 1.76, 1.78, 1.8, 1.82, 1.84, 1.86, 1.88, 1.9, 2.0, 2.1, 2.2, 2.3, 2.4, 2.5, 2.6, 2.7, 2.8, 2.9, 3.0, 3.1, 3.2, 3.3, 3.4, 3.5, or any other value greater than approximately 1.7.

The first specific gravity and the second specific gravity directly relate to the first density and the second density, respectively. Therefore, the first density of the body 10 is greater than the second density of the strike face 14. Conversely, the second density of the strike face 14 is less than the first density of the body 10.

In many embodiments, the club head (e.g. club head 100, 200, 300, 400, 500), as described herein, results in the head center of gravity 16 being positioned closer to the bottom 34 of the club head than a similar club head having a smaller ratio of the first specific gravity of the body 10 to the second specific gravity of the strike face 14. The position of the head center of gravity 16 closer to the bottom 34 of the club head results in reduced spin on the ball for wood-type club heads (e.g., drivers, fairway woods, and hybrids) and increased launch angle of the ball for iron-type club heads (e.g., irons and wedges).

The club head (e.g. club head 100, 200, 300, 400, 500), as described herein, further results in increased club head moment of inertia compared to a similar club head having a smaller ratio of the first specific gravity of the body 10 to the second specific gravity of the strike face 14. In general, club head moment of inertia increases as the amount of weight or mass distributed away from the head center of gravity 16 increases. The first material of the body 10 having a high density relative to the second material of the strike face 14 increases the amount of weight positioned away from the head center of gravity 16, and therefore increases the moment of inertia of the club head 100. Further, the second material of the strike face 14 having a low density relative to the first material of the body 10 reduces the amount of weight positioned near the head center of gravity 16, and therefore increases the moment of inertia of the club head 100.

Increased moment of inertia of the club head (e.g. club head 100, 200, 300, 400, 500) results in increased consistency in ball direction, trajectory, and distance. Specifically, increased moment of inertia of the club head about the y-axis 1500 results in increased consistency in ball direction, and increased moment of inertia of the club head about the x-axis 1400 results in increased consistency in ball trajectory and distance. In other words, increased moment of inertia of the club head 100 about the y-axis 1500 and the x-axis 1400 allows off-center hits to behave more similarly to on-center hits for the club head 100.

In many embodiments, the club head (e.g. club head 100, 200, 300, 400, 500) results in an increase in club head moment of inertia about the y-axis 1500 of up to approximately 30%, and an increase in club head moment of inertia about the x-axis 1400 of up to approximately 20% for the club head 100, 200, 300, 400, 500 having the above described ratios of the first specific gravity to the second specific gravity, compared to a similar club head with a lower ratio of the first specific gravity to the second specific gravity.

The club head (e.g. club head 100, 200, 300, 400, 500) having increased moment of inertia, as described herein, may eliminate the need to incorporate weights or to increase the the club head size to achieve the desired forgiveness or other performance characteristics. Typically, club head size is increased and weights are incorporated to increase club head moment of inertia. Eliminating weights within the club head may simplify the manufacturing process by reducing the number of manufacturing steps, reducing the amount of inventory, and reducing material cost.

The club head (e.g. club head 100, 200, 300, 400, 500) having the high density first material for the body and the low density second material for the face, resulting in increased club head moment of inertia, may also result in a more uniform club head 100 appearance compared to a club head using weight members to increase club head moment of inertia. Further, the uniform appearance of the club head may result in aerodynamic benefits leading to increased swing speeds and therefore increased ball distance.

The club head (e.g. club head 100, 200, 300, 400, 500) having the body 10 made of the high density first material may require less yield strength than a lower density first material to withstand similar forces during manufacturing and at impact. Therefore, the ability to use the high density first material with lower yield strength may further simplify manufacturing by allowing easier bending of the club head to achieve desired loft and lie angles. Easier bending of the club head due to lower material yield strength may eliminate the need for the notch or recess in the hosel, as the notch is typically used to direct stress away from the body of the club head during bending. Further, the club head having the body 10 made of the high density first material may improve the damping characteristics of the club head to prevent noise and vibrations of the club head on impact.

Figure 8:
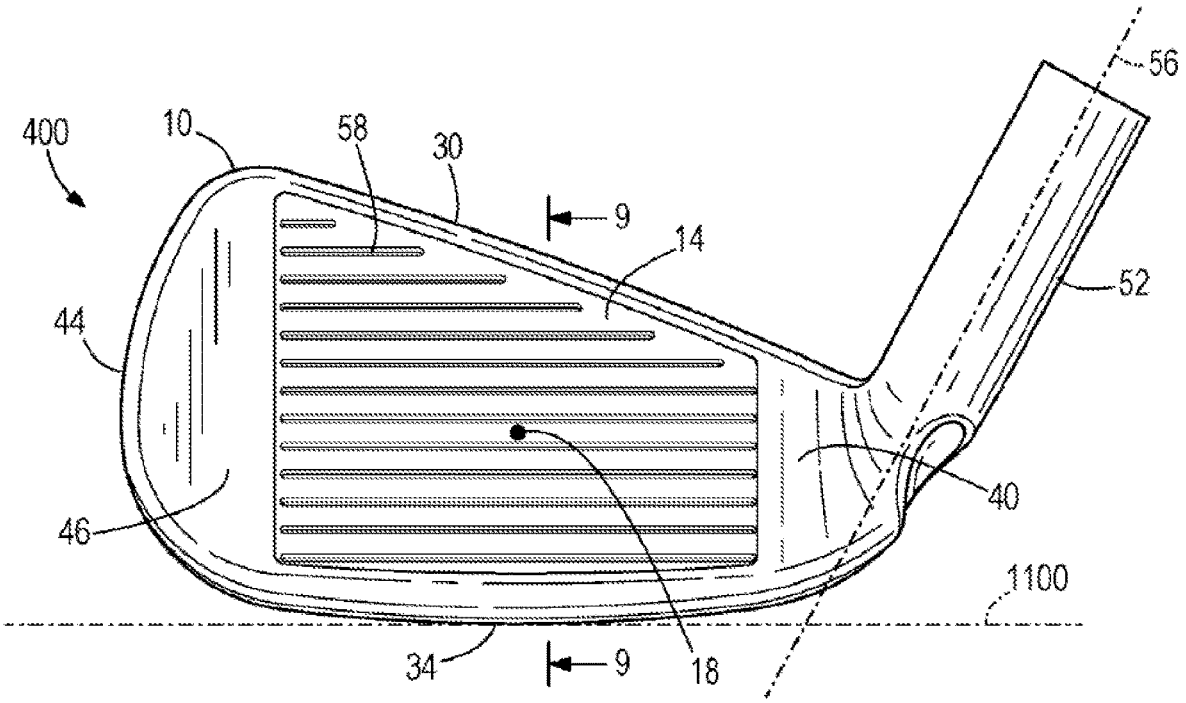
FIG. 8 illustrates a front perspective view of another embodiment of a golf club head.
Figure 9:
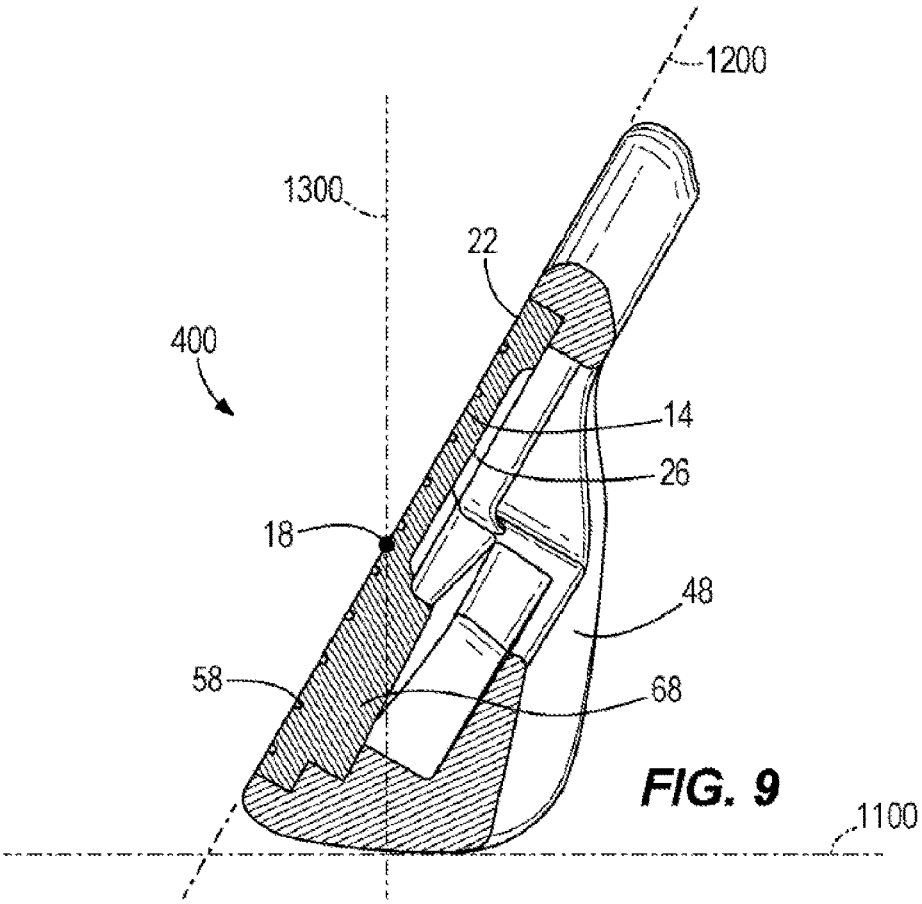
FIG. 9 illustrates a perspective, cross sectional view of the golf club head in FIG. 8, taken along line 2-2.

FIG. 8 illustrates an exemplary method of manufacturing the club head (e.g. club head 100, 200, 300, 400, 500) according to an embodiment of the invention. The method includes providing a body 10 made of a first material having a first specific gravity, the body having a top 30, a bottom 34 opposite the top 30, a heel 40, a toe 44 opposite the heel 40, and a back end 48, providing a strike face 14 made of a second material having a second specific gravity, and coupling the strike face 14 to the body 10 to form the club head.

The method of manufacturing the club head (e.g. club head 100, 200, 300, 400, 500) is merely exemplary and is not limited to the embodiments presented herein. The method can be employed in many different embodiments or examples not specifically depicted or described herein. In some embodiments, the processes of the method described can be performed in any suitable order. In other embodiments, one or more of the processes may be combined, separated, or skipped.

The body 10 of the club head (e.g. club head 100, 200, 300, 400, 500) may be manufactured by casting, machining, rapid prototyping, layer by layer printing, selective laser sintering, direct metal laser sintering, stereolithography, 3D printing, or any other method. Similarly, the strike face 14 of the club head may be manufactured by casting, machining, rapid prototyping, layer by layer printing, selective laser sintering, direct metal laser sintering, stereolithography, 3D printing, or any other method. The body 10 and the strike face 14 may be assembled by swaging, welding, brazing, or any other method capable of coupling the body 10 to the strike face 14.

In the illustrated embodiment, the club head (e.g. club head 100, 200, 300, 400, 500) is shown as an iron-type club head. However, the club head may be any type of club head including a wood-type club head (e.g., driver or fairway wood), an iron-type club head (e.g., iron or wedge), or a putter-type club head.

EXAMPLES

Example 1

In one example, a club head 100, as illustrated in FIGS. 1-5, having a body 10 made of a first material having a first specific gravity of 8.25 and a strike face 14 made of a second material having a specific gravity of 4.4 showed an increase in club head moment of inertia about the y-axis 1500 of up to approximately 15%, and an increase in club head moment of inertia about the x-axis 1400 of up to approximately 5%, compared to a similar club head having a body 10 made of a first material having a specific gravity of 7.8 and a strike face 14 made of a second material having a specific gravity of 4.6.

In this example, the first material comprises a steel alloy having approximately 18-19.5% by weight chromium, approximately 8.0-9.5% by weight nickel, approximately 8.0-10.0% by weight tungsten, with the remaining alloy composition comprising iron and other trace elements (e.g. carbon, silicon, manganese, copper, molybdenum). Further, in this example, the second material comprises a titanium alloy (Ti-6-4) having approximately 6% by weight aluminum, 4% by weight Vanadium, with the remaining composition comprising titanium and other trace elements (e.g. oxygen and iron).

Example 2

In another example, a club head 100, as illustrated in FIGS. 1-5, having a first specific gravity of approximately 9.3 and a second specific gravity of approximately 4.4 (i.e., an exemplary club head 100 having a ratio of the first specific gravity to the second specific gravity of approximately 2.27) resulted in a 7.3% increase in the moment of inertia about the x-axis 1400 (Ixx), on average, and a 7.2% increase in the moment of inertia about the y-axis 1500 (Iyy), on average, compared to a similar club head having a ratio of the first specific gravity to the second specific gravity less than 1.7 (i.e., a control club head), as illustrated in Table 1 below.

In this example, the first material comprises a steel alloy having approximately 12-13.5% by weight chromium, approximately 48-50% by weight nickel, approximately 18.0-21.5% by weight tungsten, approximately 1.5-2.0% by weight molybdenum, with the remaining alloy composition comprising iron and other trace elements (e.g. carbon, silicon, manganese, and copper). Further, in this example, the second material comprises a titanium alloy (Ti-6-4) having approximately 6% by weight aluminum and 4% by weight Vanadium, with the remaining composition comprising titanium and other trace elements (e.g. oxygen and iron).

TABLE 1

Increased moment of inertia of an exemplary club head 100 compared to a control club head

| | Average Club Head Mass (g) | Ixx ($g \cdot cm^2$), Average | Iyy ($g \cdot cm^2$), Average |
|---|---|---|---|
| Club Head 100 | 258.3 | 684.5 | 2537.5 |
| Control Club Head | 257.1 | 638.0 | 2368.0 |

In this example, the first specific gravity of the control club head is approximately 7.8, the second specific gravity of the control club head is approximately 7.8, and the ratio of the first specific gravity to the second specific gravity of the club head is approximately 1.0. Further, in this example, the moment of inertia about the x-axis 1400 and the moment of inertia about the y-axis 1500 of the club head 100 and the control club head were determined using the United States Golf Association's (USGA's) Procedure for Measuring the Moment of Inertia of Golf Club Heads, Revision 1.0, April 2006. Table 1 illustrates the above described results.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

What is claimed is:

1. A golf club head comprising:

a body comprising a first material and a first specific gravity, the body further comprising:
- a top;
- a bottom opposite the top;
- a heel;
- a toe opposite the heel; and
- a back end;

a strike face comprising a second material having a second specific gravity; wherein:
- the second specific gravity is less than the first specific gravity;
- a ratio of the first specific gravity to the second specific gravity is greater than or equal to 1.7;
- the body of the golf club head and the strike face are coupled together by welding;

the body further comprises:
- a center of gravity;
- a first support member positioned adjacent to the top of the body and a back side of the strike face, and a second support member spaced from the first support member and positioned adjacent to the bottom of the body and the back side of the strike face; and
- wherein the body defines a cavity, wherein the cavity is positioned near the back end of the body, offset from the back side of the strike face;

wherein the offset of the cavity from the strike face is greater near the heel and the toe than near the center of gravity; and wherein the cavity is configured to receive a weight.

2. The golf club head of claim 1, wherein the first specific gravity is greater than or equal to 7.8.

3. The golf club head of claim 1, wherein the second specific gravity is less than or equal to 4.6.

4. The golf club head of claim 1, wherein a cross-sectional area of the cavity varies with position from the heel and/or the toe.

5. The golf club head of claim 1, wherein a cross-sectional shape of the cavity has at least one curved surface.

6. The golf club head of claim 1, wherein the cavity is rectangular or triangular in shape.

7. The golf club head of claim 1, wherein the cavity has a constant shape and cross-sectional area at various positions relative to the heel and the toe.

8. A golf club head comprising:

a body comprising a first material and a first specific gravity, the body further comprising:

a top;

a bottom opposite the top;

a heel;

a toe opposite the heel; and a back end;

a center of gravity;

a strike face comprises a second material having a second specific gravity; wherein:

the second specific gravity is less than the first specific gravity;

a ratio of the first specific gravity to the second specific gravity is greater than or equal to 1.7;

the body of the golf club head and the strike face are coupled together by welding;

the body further defines a cavity, wherein the cavity is positioned near the back end of the body, directly adjacent to the strike face;

wherein an offset of the cavity from the strike face is greater near the heel and the toe than near the center of gravity;

wherein the cavity is configured to receive a weight.

9. The golf club head of claim 8, wherein the first specific gravity is greater than or equal to 7.8.

10. The golf club head of claim 8, wherein the second specific gravity is less than or equal to 4.6.

11. The golf club head of claim 8, wherein a top of the strike face and a bottom of the strike face are supported by the body.

12. The golf club head of claim 11, wherein the top of the strike face is supported by the body along a first length and the bottom of the strike face is supported by the body along a second length.

13. The golf club head of claim 8, wherein the cavity is open and not enclosed.

14. The golf club head of claim 8, wherein the strike face comprises a protruding back portion, and wherein the cavity is positioned directly adjacent the protruding back portion of the strike face.

15. The golf club head of claim 8, wherein a cross-sectional area of the cavity varies with position from the heel and/or the toe.

16. The golf club head of claim 8, wherein the cavity is rectangular in shape and has a constant shape and cross-sectional area at various positions relative to the heel and the toe.

17. The golf club head of claim 8, wherein the golf club head is an iron-type golf club head.

* * * * *